US005870795A

United States Patent [19]

Sizemore

[11] Patent Number: 5,870,795

[45] Date of Patent: Feb. 16, 1999

[54] PAINT ROLLER WITH MAGNET LOCK

[76] Inventor: James W. Sizemore, 370 NE. 14 St., Homestead, Fla. 33030

[21] Appl. No.: 786,647

[22] Filed: Jan. 21, 1997

[51] Int. Cl.[6] ..... B05C 17/02

[52] U.S. Cl. ..... 15/230.11; 492/13; 492/19

[58] Field of Search ..... 15/230.11; 492/13, 492/19

[56] References Cited

U.S. PATENT DOCUMENTS

| | | | |
|---|---|---|---|
| 3,060,555 | 10/1962 | Kirshenbaum et al. | 15/230.11 X |
| 3,906,581 | 9/1975 | Marino et al. | 15/230.11 |

FOREIGN PATENT DOCUMENTS

| | | | |
|---|---|---|---|
| 1103324 | 5/1955 | France | 15/230.11 |
| 64044 | 5/1955 | France | 15/230.11 |
| 1168672 | 9/1958 | France | 15/230.11 |
| 1558712 | 4/1990 | U.S.S.R. | 15/230.11 |
| 1353027 | 5/1979 | United Kingdom | 15/230.11 |
| 748329 | 4/1986 | United Kingdom | 15/230.11 |

*Primary Examiner*—Mark Spisich
*Attorney, Agent, or Firm*—Robert J. Van Der Wall

[57] ABSTRACT

An apparatus for applying flowable material to a work surface includes a frame structure having a handle portion and an axle portion; a roller cover mounting structure rotatably mounted on the axle portion; a roller cover having an outer cover surface and engagingly fitted over the roller cover mounting structure, for gathering a quantity of the flowable material on the outer cover surface and transferring at least part of the quantity of flowable material to the work surface; and a mounting structure locking mechanism for locking the mounting structure against rotation relative to the frame structure. The locking mechanism preferably locks the mounting structure against rotation releasably, so that the roller cover transfers the flowable material by either rotating or by sliding against the work surface.

19 Claims, 2 Drawing Sheets

PAINT ROLLER WITH MAGNET LOCK

BACKGROUND OF THE INVENTION

1. Field of the Invention

The present invention relates generally to the field of paint application devices. More specifically the present invention relates to a roller apparatus for applying paint, stain and other flowable material to a work surface. The roller apparatus includes a roller frame with a handle portion at one end, an axle portion at the other end, and a roller assembly mounted on the axle portion for removably receiving a conventional roller cover. The roller assembly contains a releasable locking mechanism which frees the roller cover to rotate freely about the axle portion for the conventional rolling application of flowable material, and which alternatively locks the roller cover against rotation about the axle portion for a sliding application of the material.

2. Description of the Prior Art

There have long been roller devices for applying paint and other material to work surfaces. A problem with these prior devices has been that a smooth finish is often not attainable because the material transferred by the device rolling element leaves elevated irregularities, such as stipples and bubbles, as the element surface rides over and lifts away from the work surface. Applicant has discovered that a sliding action produces a smooth finish virtually free of such irregularities. These prior devices are not constructed to perform a sliding application.

An example of such a prior roller device is that of Morgan, et al., U.S. Pat. No. Des. 305,080, filed on Jun. 1, 1987, for what is termed a paint roller frame. Morgan, et al., includes the conventional bent rod roller framework with rotatably mounted, spaced apart cover support disks and an outwardly bowed, longitudinally oriented, wire cage for mounting a roller cover. A problem with Morgan, et al., is that the cover support disks and mounting cage are always free to rotate, so that sliding the roller cover to apply material is awkward or impossible.

Another prior device is that of Jacobs, et al., U.S. Pat. No. 5,182,840, filed on Dec. 19, 1991. Jacobs, et al., discloses an epoxy floor roller tool and method of making the tool for removing air bubbles from an already applied layer of epoxy and polyurethane floor coating materials. A problem with Jacobs, et al., is that no provision is made for sliding application of flowable material. Another problem with Jacobs, et al., is that two steps are required in the material application, namely those of applying the material over the work surface and of subsequently rolling the Jacobs, et al., device over the wet material to remove bubbles. This procedure virtually doubles the work time needed for the project, and similarly increases the cost as well.

It is thus an object of the present invention to provide a roller apparatus which is capable of applying flowable material to a work surface in a rolling mode, and which can alternatively apply the material in a sliding mode.

It is another object of the present invention to provide such an apparatus which changes modes of operation simply by shaking or bumping the apparatus, so that no tools or work interruption are necessary.

It is still another object of the present invention to provide such an apparatus which has the familiar feel and appearance of a conventional paint roller device, and which accepts the conventional and widely available roller covers.

It is finally an object of the present invention to provide such an apparatus which is durable, reliable, simple in design and inexpensive to manufacture.

SUMMARY OF THE INVENTION

The present invention accomplishes the above-stated objectives, as well as others, as may be determined by a fair reading and interpretation of the entire specification.

An apparatus is provided for applying flowable material to a work surface, including a frame structure having a handle portion and an axle portion; a roller cover mounting structure rotatably mounted on the axle portion; a roller cover having an outer cover surface and engagingly fitted over the roller cover mounting structure, for gathering a quantity of the flowable material on the outer cover surface and transferring at least part of the quantity of flowable material to the work surface; and a mounting structure locking mechanism for locking the mounting structure against rotation relative to the frame structure.

The locking mechanism preferably locks the mounting structure against rotation releasably. The roller cover mounting structure preferably includes a radial support structure rotatably mounted on the axle portion for fitting within and supporting the roller cover. The locking structure preferably includes a pin member retaining structure fixedly mounted to the frame structure and at least one pin member slidably retained within the pin member retaining structure, and the radial support structure preferably includes at least one pin member receiving recess, so that the pin member slides into the receiving recess to lock the radial support structure against rotation relative to the frame structure and slides out of the receiving recess to free the radial support structure to rotate relative to the frame structure.

The pin member preferably includes magnetically attractive material, and the apparatus preferably additionally includes a first magnet for releasably retaining the locking pin member in a position out of the recess; and a second magnet for releasably retaining the locking pin member within the recess.

The radial support structure preferably includes a tubular side wall having an outer diameter sized to snugly fit within the roller cover; a mounting tube located axially within the tubular side wall; several radial fins extending between and interconnecting the tubular side wall and the mounting tube; and an end wall extending from the mounting tube radially outwardly to the tubular side wall; where the radial fins separate several sections defining the several of the recesses within the tubular side wall. The at least one pin member is preferably substantially parallel with and spaced a radial distance out from the axle portion, and the second magnet preferably includes a section magnet secured within each recess at a radial distance from the axle portion corresponding to the radial distance of the pin member from the axle portion. The first magnet preferably includes a magnetic disk mounted on the axle portion and extending radially out from the axle portion a distance corresponding to the radial distance of the pin member from the axle portion.

The pin member retaining structure preferably includes a cylinder fixedly and axially mounted around the axle portion and having a longitudinal pin member passageway extending substantially parallel with and spaced a radial distance outward from the axle portion for slidably receiving the at least one pin member.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
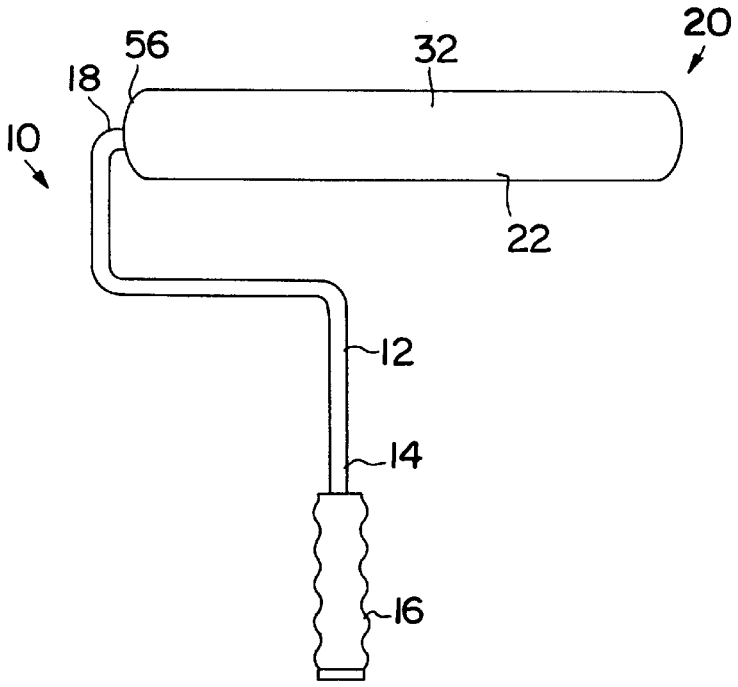
FIG. 1 is a side view of the entire roller apparatus having a roller cover mounted for use.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
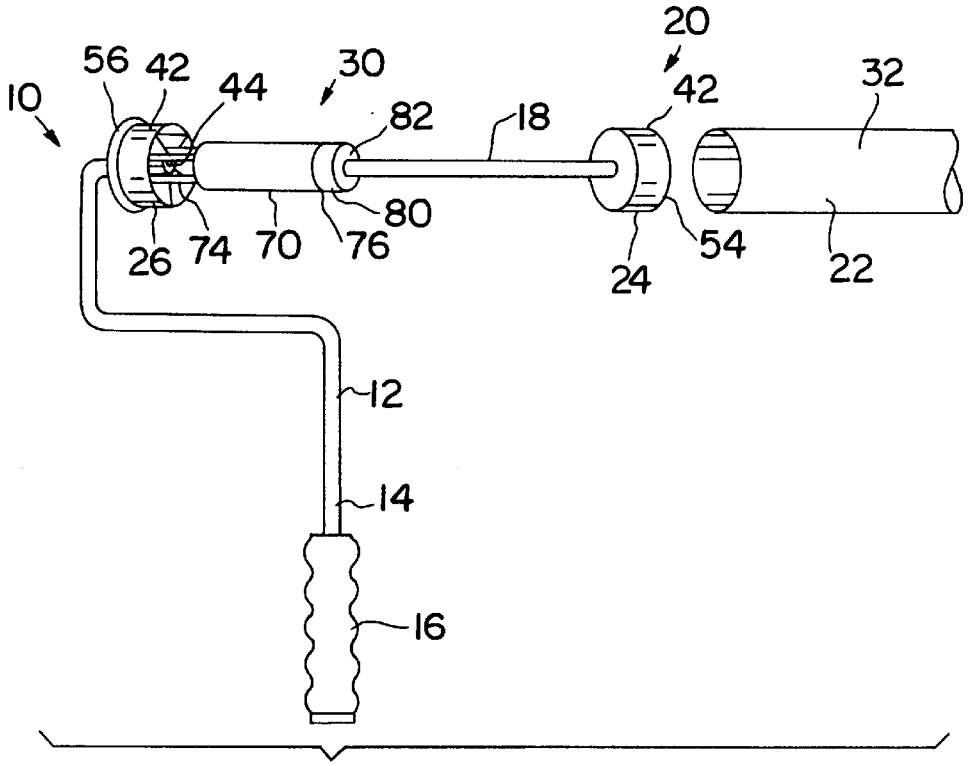
FIG. 2 is a side view as in FIG. 1 with the roller cover removed and positioned to a side of the apparatus ready for installation, and revealing the first and second support disks and the inventive locking mechanism.
Figure 3:
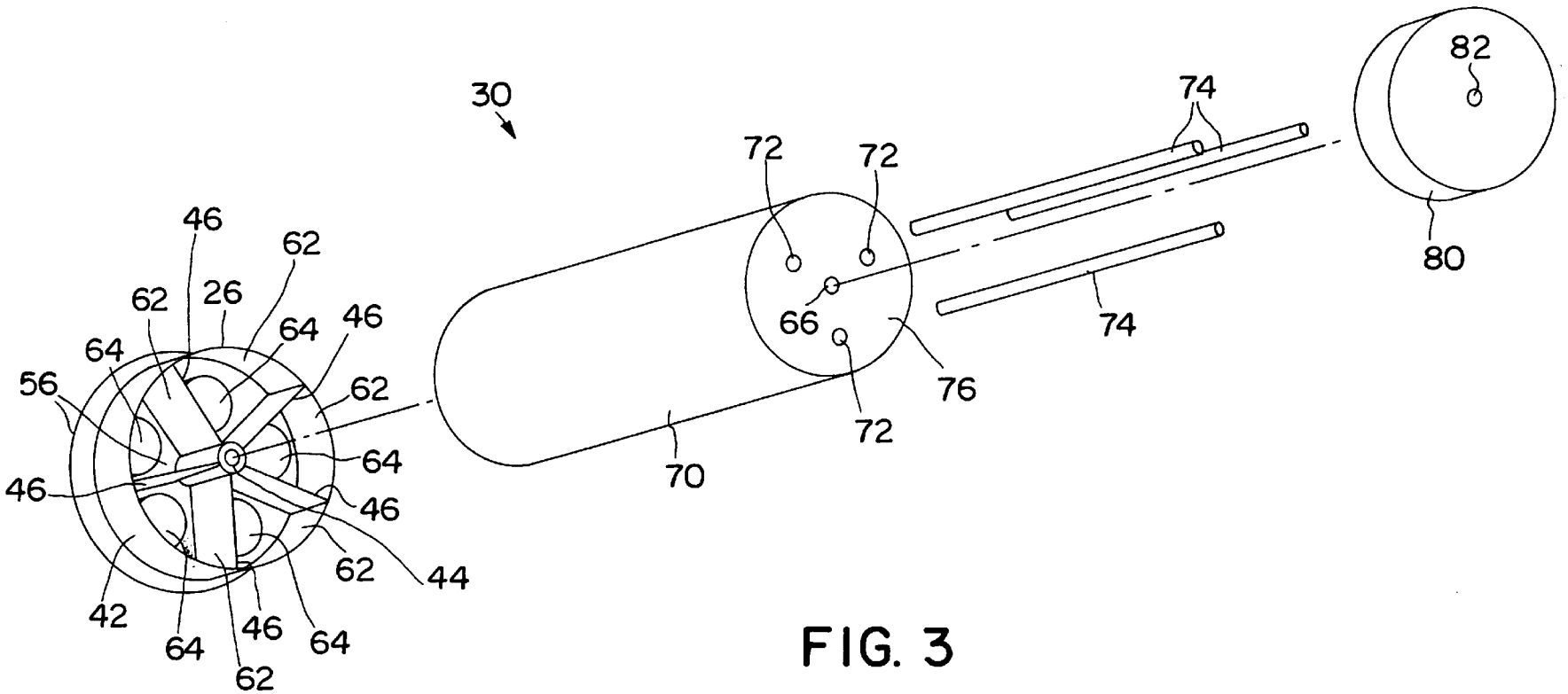
FIG. 3 is an exploded, detailed view of the elements making up the locking mechanism, including the second end cap and section magnets, the cylinder and pin passageways, the pins and the disk magnet.

Referring to FIGS. 1–3, a roller apparatus 10 is disclosed for applying paint and other flowable material to work surfaces. Apparatus 10 includes a conventional roller frame 12 with a handle portion 14 and grip 16 at one end and an axle portion 18 at the other end, and a roller assembly 20 mounted on axle portion 18. Roller assembly 20 includes a removable and replaceable roller cover 22 for receiving and transferring the flowable material, a roller cover first support disk 24 rotatably mounted at the axle portion 18 free end, and a roller cover second support disk 26 rotatably mounted at the axle portion 18 connected end. Roller assembly 20 contains a releasable locking mechanism 30.

Locking mechanism 30 permits the roller cover 22 to rotate freely about axle portion 18 for the conventional rolling application of flowable material, and to alternatively lock the roller cover 22 against rotation about axle portion 18 for a sliding application of the material.

Roller cover 22 is a tubular member having a flowable material retaining surface 32 of conventional construction. First and second support disks 24 and 26, respectively, are also of conventional construction, each including a tubular side wall 42 having an outer diameter sized to snugly fit within the roller cover 22, a mounting tube 44 axially positioned within tubular side wall 42 and five radial fins 46 extending between and interconnecting tubular side wall 42 and mounting tube 44. See FIGS. 2 and 3. First support disk 24 also includes a first end wall 54 which extends from the mounting tube 44 outwardly to, but not beyond, the tubular side wall 42. Second support disk 26 includes a second end wall 56 which is like first end wall 54 except that it extends radially outward beyond the side wall 42 for stopping and abutting a roller cover 22 fit over first and second support disks 24 and 26. The five radial fins 46 divide the interiors of support disks 24 and 26 and the inner surfaces of end walls 54 and 56 into five equal radial sections 62.

Locking mechanism 30 preferably includes five section magnets 64, each affixed to second end wall 56 and each occupying one of its radial sections 62. See FIG. 3. Locking mechanism 30 further includes a cylinder 70 having a smaller diameter than support disks 24 and 26, and a longitudinal axial bore 66 fitted over and affixed around axle portion 18 between first and second support disks 24 and 26, respectively. Cylinder 70 preferably includes three longitudinal pin passageways 72 located substantially equidistant from and evenly distributed about cylinder axial bore 66, with a pin member 74 slidably fitted into each pin passageway 72. Each pin member 74 is made of steel or some other magnetically attractive material, and is preferably of substantially the same length as cylinder 70. A disk magnet 80 with an axial bore 82 is fixedly mounted around axle portion 18 adjacent to and abutting a first end 76 of cylinder 70.

Roller cover 22 is supported between support disks 24 and 26 by a wire cage of conventional design which has been omitted from FIG. 2 for clarity. The wire cage forms no part of the invention, it being a portion of the structure of a conventional paint roller.

Method

In practicing the invention, the following method may be used. For apparatus 10 operation in the rotating roller cover mode, the pin members 74 are positioned against and retained by disk magnet 80. To convert apparatus 10 operation to the fixed roller cover mode for sliding application of material, the user simply lowers the axle portion 18 second end relative to the first end and bumps apparatus 10, preferably an end of axle portion 18, against the palm of a hand or another object. This action jars pin members 74 loose from disk magnet 80 and permits them to slide within passageways 72 into registering radial sections 62 in second support disk 26, where they are releasably retained by corresponding section magnets 64. Since cylinder 70 is fixed against rotation relative to axle portion 18, pin members 74 extending between the cylinder 70 and second support disk 26 hold second support disk 26 fixed against rotation as well by laterally abutting said support disk 26 radial fins 46. To return apparatus 10 to the rotating roller cover mode, the user simply lowers the axle portion 18 first end relative to the second end and bumps apparatus 10. This jars pin members 74 loose from section magnets 64 and permits pin members 74 to slide out of the radial sections 62 within passageways 72 and once again into retaining contact with disk magnet 80. Since the cylinder 70 and second support disk 26 are thereby disconnected, the second support disk 26 and roller cover 22 are again freed to rotate relative to cylinder 70 and axle portion 18.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

PARTS LIST

10. Apparatus
12. Roller frame
14. Handle portion
16. Grip
18. Axle portion
20. Roller assembly
22. Roller cover -continued

PARTS LIST

24. First support disk
26. Second support disk
30. Locking mechanism
32. Flowable material retaining surface on cover
42. Tubular side wall of support disks
44. Mounting tube of support disks
46. Radial fins of support disks
54. First disk end wall
56. Second disk end wall
62. Radial sections
64. Section magnets
66. Axial bore in cylinder
70. Cylinder
72. Pin passageways
74. Pin members
76. First end of cylinder (beside disk magnet)
80. Disk magnet
82. Axial bore in disk magnet

I claim as my invention:

1. An apparatus for applying flowable material to a work surface, comprising:

a frame structure having a handle portion and an axle portion;

first and second support disks rotatably mounted on said axle portion;

a roller cover having an outer cover surface and engagingly fitted over said first and second support disks, for gathering a quantity of said flowable material on said outer cover surface and transferring at least part of said quantity of flowable material to said work surface;

and support disk locking means for locking said first support disk against rotation relative to said frame structure, said locking means being disposed completely within a volume formed by the first and second support disks and the roller cover so that it is totally shielded from any contact with said flowable material.

2. The apparatus of claim 1, wherein said locking means locks said first support disk against rotation releasably.

3. The apparatus of claim 2, each said roller cover support disk comprising a radial support means rotatably mounted on said axle portion for fitting within and supporting said roller cover.

4. The apparatus of claim 3, said locking means comprising a pin member retaining means fixedly mounted to said frame structure and at least one pin member slidably retained within said pin member retaining means, and wherein said radial support means comprises at least one pin member receiving recess, such that said pin member slides into said receiving recess to lock said radial support means against rotation relative to said frame structure and slides out of said receiving recess to free said radial support means to rotate relative to said frame structure.

5. The apparatus of claim 4, wherein said pin member comprises magnetically attractive material.

6. The apparatus of claim 5, additionally comprising:

first magnet means for releasably retaining said locking pin member in a position out of said recess;

and second magnet means for releasably retaining said locking pin member within said recess.

7. The apparatus of claim 6, wherein said radial support means comprises:

a tubular side wall having an outer diameter sized to snugly fit within said roller cover;

a mounting tube located axially within said tubular side wall;

a plurality of radial fins extending between and interconnecting said tubular side wall and said mounting tube;

an end wall extending from said mounting tube radially outwardly to said tubular side wall;

wherein said radial fins separate a plurality of sections defining several of said recesses within said tubular side wall.

8. The apparatus of claim 7, wherein said at least one pin member is substantially parallel with and spaced a radial distance out from said axle portion, and wherein said second magnet means comprises a section magnet secured within each said recess at a radial distance from said axle portion corresponding to the radial distance of said pin member from said axle portion.

9. The apparatus of claim 8, wherein said first magnet means comprises a magnetic disk mounting on said axle portion and extending radially out from said axle portion a distance corresponding to the radial distance of said pin member from said axle portion.

10. The apparatus of claim 9, wherein said pin member retaining means comprises a cylinder fixedly and axially mounted around said axle portion and having a longitudinal pin member passageway extending substantially parallel with and spaced a radial distance outward from said axle portion for slidably receiving said at least one pin member.

11. An apparatus for applying flowable material to a work surface, comprising:

a frame structure having a handle portion and an portion;

a roller cover mounting structure having radial support means and rotatably mounted on said axle portion;

a roller cover having an outer cover surface engagingly fitted over and supported by said radial support means of said roller cover mounting structure, for gathering a quantity of said flowable material on said outer cover surface and transferring at least part of said quantity of flowable material to said work surface;

and mounting structure locking means for releasably locking said mounting structure against rotation relative to said frame structure and having a pin member retaining means fixedly mounted to said frame structure and at least one pin member slidably retained within said pin member retaining means, and wherein said radial support means comprises at least one pin member receiving recess, such that said pin member slides into said receiving recess to lock said radial support means against rotation relative to said frame structure and slides out of said receiving recess to free said radial support means to rotate relative to said frame structure.

12. The apparatus of claim 11, wherein said pin member comprises magnetically attractive material.

13. The apparatus of claim 12, additionally comprising:

first magnet means for releasably retaining said locking pin member in a position out of said recess;

and second magnet means for releasably retaining said locking pin member within said recess.

14. The apparatus of claim 13, wherein said radial support means comprises:

a tubular side wall having outer diameter sized to snugly fit within said roller cover;

a mounting tube located axially within said tubular side wall;

a plurality of radial fins extending between and interconnecting said tubular side wall and said mounting tube;

an end wall extending from said mounting tube radially outwardly to said tubular side wall;

wherein said radial fins separate a plurality of sections defining several of said recesses within said tubular side wall.

15. The apparatus of claim 14, wherein said at least one pin member is substantially parallel with and spaced a radial distance out form said axle portion, and wherein said second magnet means comprises a section magnet secured within each said recess at a radial distance from said axle portion corresponding to the radial distance of said pin member from said axle portion.

16. The apparatus of claim 15, wherein said first magnet means comprises a magnetic disk mounting on said axle portion and extending radially out from said axle portion a distance corresponding to the radial distance of said pin member from said axle portion.

17. The apparatus of clam 16, wherein said pin member retaining means comprises a cylinder fixedly and axially mounted around said axle portion and having a longitudinal pin member passageway extending substantially parallel with and spaced a radial distance outward from said axle portion for slidably receiving said at least one pin member.

18. An apparatus for applying flowable material to a work surface, comprising:

a frame structure having a handle portion and an axle portion;

first and second support disks rotatably mounted on said axle portion;

a roller cover having an outer cover surface and engagingly fitted over said first and second support disks, for gathering a quantity of said flowable material on said outer cover surface and transferring at least part of said quantity of flowable material to said work surface;

and locking means for releasably locking and unlocking one of said support disks against rotation relative to said frame structure which locking means includes at least one magnet means.

19. The apparatus of claim 18 in which said locking means further comprises a first magnet means for releasably retaining said locking means in an unlocked mode, and a second magnet means for releasably retaining said locking means in a locked mode.

* * * * *